US009782873B2

(12) United States Patent
Chi

(10) Patent No.: US 9,782,873 B2
(45) Date of Patent: Oct. 10, 2017

(54) SWITCHING DEVICE FOR RATCHET WRENCH

(71) Applicant: Yen-Ju Chi, Taichung (TW)

(72) Inventor: Yen-Ju Chi, Taichung (TW)

( * ) Notice: Subject to any disclaimer, the term of this patent is extended or adjusted under 35 U.S.C. 154(b) by 219 days.

(21) Appl. No.: 14/792,850

(22) Filed: Jul. 7, 2015

(65) Prior Publication Data

US 2016/0288299 A1 Oct. 6, 2016

(30) Foreign Application Priority Data

Mar. 30, 2015 (TW) ..... 104110345 A

(51) Int. Cl.
*B25B 13/46* (2006.01)
*B25B 23/00* (2006.01)

(52) U.S. Cl.
CPC ..... *B25B 13/463* (2013.01); *B25B 23/0035* (2013.01)

(58) Field of Classification Search
CPC .... B25B 13/46; B25B 13/463; B25B 23/0035
USPC ..... 81/60, 63.2
See application file for complete search history.

(56) References Cited

U.S. PATENT DOCUMENTS 6,382,052 B1 * 5/2002 Chen ..... B25B 13/463 81/63
7,096,763 B1 * 8/2006 Hsieh ..... B25B 13/463 81/60
7,121,171 B2 * 10/2006 Hsien ..... B25B 13/04 81/60
8,650,991 B2 * 2/2014 Lin ..... B25B 13/463 81/60
9,032,845 B2 * 5/2015 Lin ..... B25B 13/463 81/61
9,114,510 B2 * 8/2015 Lee ..... B25B 13/463

* cited by examiner

*Primary Examiner* — Hadi Shakeri
(74) *Attorney, Agent, or Firm* — Alan D. Kamrath; Kamrath IP Lawfirm, P.A.

(57) ABSTRACT

A ratchet wrench includes a head with a driving member located in a first room thereof. A clip is engaged with a first groove in the first room and a second groove in the driving member to retain the driving member in the first room. A pawl is received in a second room defined in the inside of the first room and engaged with the driving member. The pawl has a lip on the rear side thereof. A switching device is located in a third room communicating with the second room and outside of the wrench. The lip is inserted in a slot in the switching device. The switching device has a board which is rested on the lip and pushes either one of the two inclined faces of the recess in the rear side of the pawl to change the ratcheting engagement between the pawl and the driving member.

6 Claims, 12 Drawing Sheets

SWITCHING DEVICE FOR RATCHET WRENCH

BACKGROUND OF THE INVENTION

1. Fields of the invention

The present invention relates to a switching device for a ratchet wrench.

2. Descriptions of Related Art

The conventional ratchet wrench generally comprises a head with a handle extending from the head. The head has a through hole so as to receive a driving member therein. A side hole is defined in the inner periphery of the through hole in the head so as to receive a pawl therein. A switching unit is located in the neck portion which is connected between the head and the handle. The switching unit is operated to control the pawl to change the ratcheting direction of the driving member. A cover is then mounted to the top of the handle and is secured by bolts which extend through the cover and are threadedly connected to the head, so that the driving member, the pawl and the switching unit are retained in the head and the neck portion.

However, the bolts are exposed from the cover and the head, so that the bolts make the wrench not meet requirements of aesthetic purposes. This will affects the value in the market. Besides, the exposed bolts allow the users to remove the bolts and access the parts in the head of the wrench. The parts are tiny and need to be positioned correctly to make the wrench function properly. Once the cover is removed, the tiny parts can easily lost.

The present invention intends to provide a switching device for a ratchet wrench to eliminate the shortcomings mentioned above.

SUMMARY OF THE INVENTION

The present invention relates to a ratchet wrench and comprises a body having a head, and a handle is connected to the head. The head has a first room defined therethrough, and a second room is defined in the inner periphery of the first room. A third room is defined in the inner periphery of the second room and has an opening which opens through a first side of the head. A support flange extends inward from the inner periphery of the first room and located at the lower portion of the head. A first groove is defined in the inner periphery of the first room and located at the top portion of the head. The second room is located between and communicates with the first and third rooms. The second room is located beneath and covered by a portion of the head, and not opening to outside of the body.

A driving member is located in the first room and has a polygonal driving portion defined therein. A second groove is defined in the outer periphery of the driving member and located at the top portion of the driving member. An annular flange extends from the underside of the driving member. Multiple first teeth are formed in the outer periphery of the driving member and located between the second groove and the annular flange. A clip is engaged with the first and second grooves to retain the driving member in the first room.

A pawl is located in the second room and has a recessed and curved front side in which multiple second teeth are defined. A recessed portion is defined in the rear side of the pawl and a lip extends from the inner periphery of the recessed portion. A recess is formed between the lip and an upper portion of the recessed portion.

A switching device is inserted in the third room and has a tubular portion and a lever extends radially from the tubular portion. A slot is defined radially in the outside of the tubular portion and has an inner top and an inner bottom. A board protrudes from the inner top of the slot. The lip is inserted in the slot and the board is rested on the lip and located in the recess. The board pushes the inside of the recess to move the pawl in the second room. A hole is defined radially through the tubular portion and located beneath the slot. A push unit is located in the hole of the tubular portion and resiliently contacts between the inner periphery of the recessed portion and the inner end of the hole.

The primary object of the present invention is to provide a ratchet wrench which uses only one clip to retain the driving member in the head of the wrench without using bolts and cover.

Another object of the present invention is to provide a ratchet wrench wherein the pawl is pushed by using the board of the switching device to push the first or second inclined faces of the recess at the rear side of the pawl. The pawl is moved within the second room precisely and stably. A high torque is able to output from the ratchet wrench.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
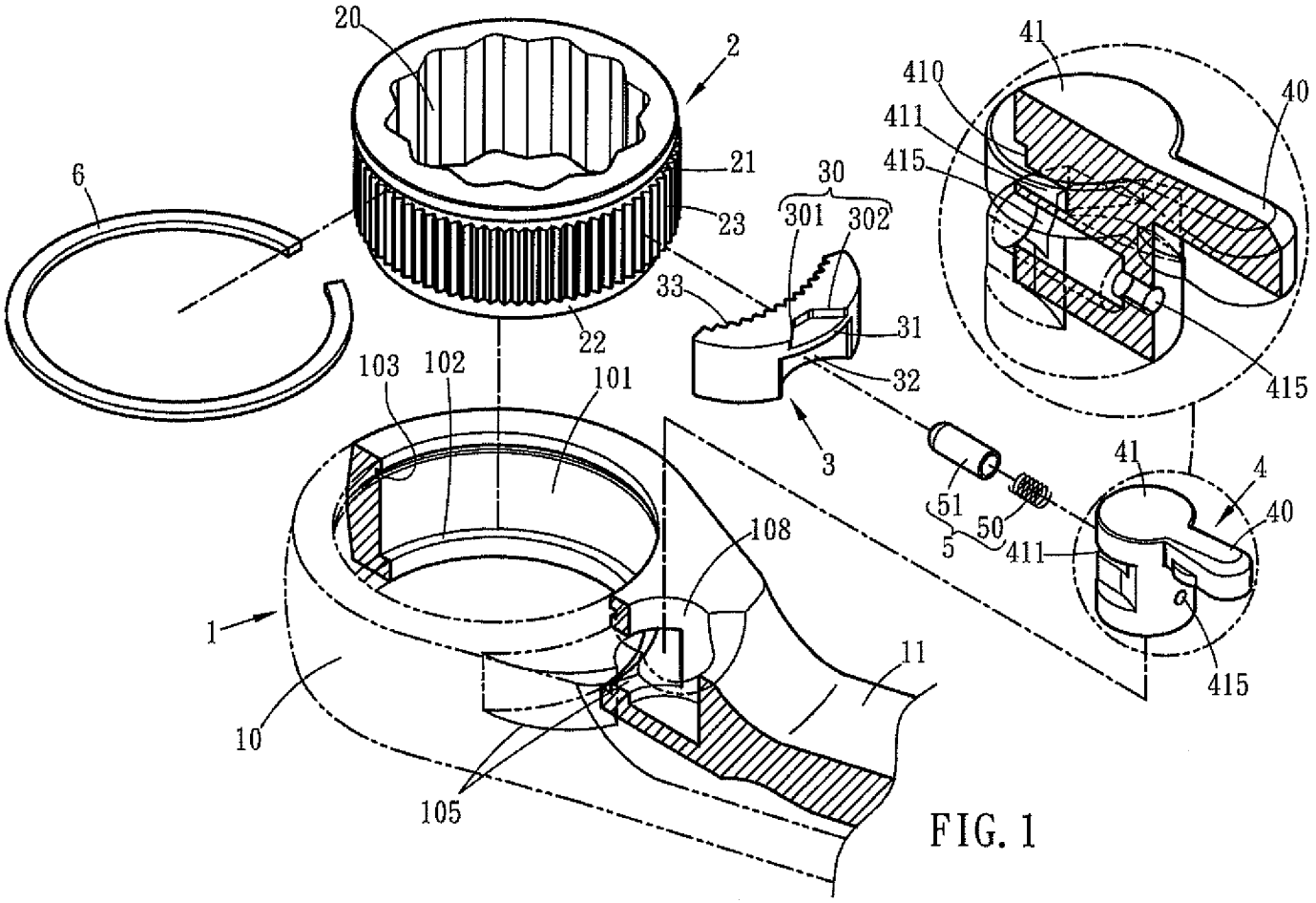
FIG. 1 is an exploded view of the ratchet wrench of the present invention.
Figure 4:
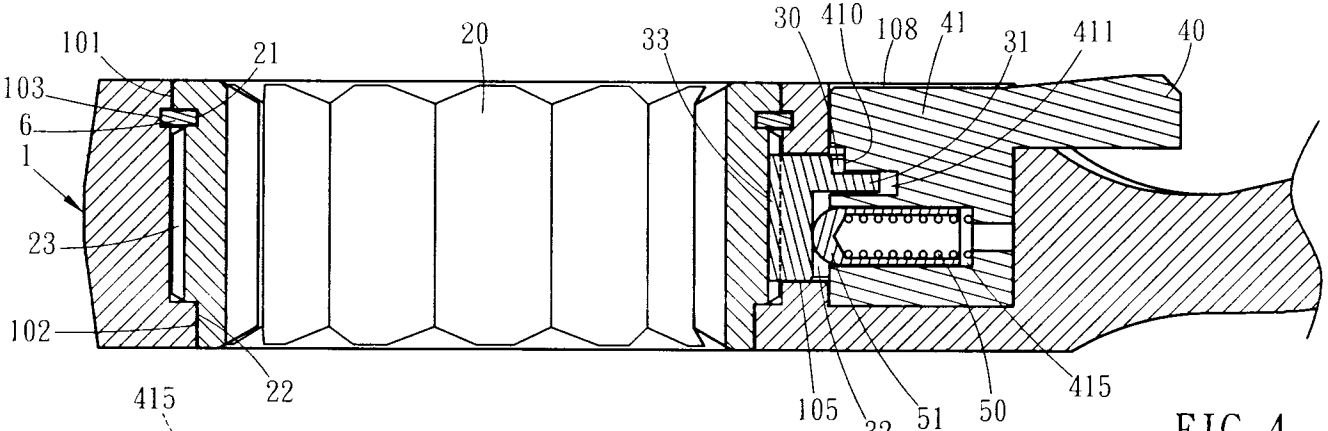
FIG. 4 is a side cross sectional view to show the ratchet wrench of the present invention.

Referring to FIGS. 1 to 4, the ratchet wrench of the present invention comprises a body 1 having a head 10, and a handle 11 is connected to the head 10. The head 10 has a first room 101 defined therethrough. A second room 105 is defined in the inner periphery of the first room 101. A third room 108 is defined in the inner periphery of the second room 105 and has an opening which opens through a first side of the head 10. A support flange 102 extends inward from the inner periphery of the first room 101 and located at the lower portion of the head 10. A first groove 103 is defined in the inner periphery of the first room 101 and located at the top portion of the head 10. The second room 105 is located between and communicates with the first and third rooms 101, 108. The second room 105 is located beneath and covered by a portion of the head 10, and does not open to outside of the body 1 directly. The first groove 103 of the first room 101 and the opening of the third room 108 are located on the same side of the body 1. The first groove 103 of the first room 101 and the opening of the third room 108 may be located on two opposite sides of the body 1.

A driving member 2 is located in the first room 101 and has a polygonal driving portion 20 defined therein. The driving portion 20 is used to accommodate a nut or a head of a bolt. The annular flange 22 extends through the area enclosed by the support flange 102. A second groove 21 is defined in the outer periphery of the driving member 2 and located at the top portion of the driving member 2. An annular flange 22 extend from the underside of the driving member 2. Multiple first teeth 23 are formed in the outer periphery of the driving member 2 and located between the second groove 201 and the annular flange 22. A clip 6 is engaged with the first and second grooves 103, 21 to retain the driving member 2 in the first room 101.

Figure 3:
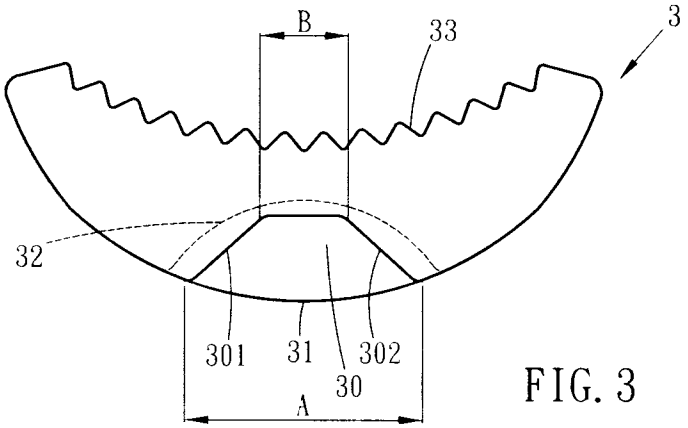
FIG. 3 shows the top view of the pawl of the ratchet wrench of the present invention.
Figure 2:
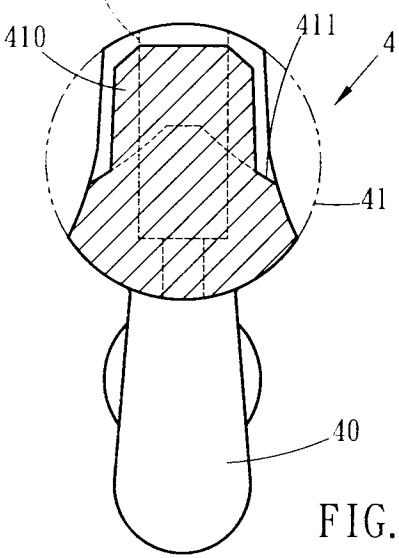
FIG. 2 is a cross sectional view to show the switching device of the ratchet wrench of the present invention.

A pawl 3 is located in the second room 105 and has a recessed and curved front side. Multiple second teeth 33 are defined in the front side of the pawl 3 so as to be engaged with the first teeth 23 of the driving member 2. A recessed portion 32 is defined in the rear side of the pawl 3 and a lip 31 extends from the inner periphery of the recessed portion 32. A recess 30 is formed between the lip 31 and the upper portion of the recessed portion 32. The recess 30 is defined by two inclined faces 301, 302. The first and second inclined faces 301, 302 form an open end "A" and a closed end "B". The width of the open end "A" is wider than the width of the closed end "B" as shown in FIG. 3.

Figure 5:
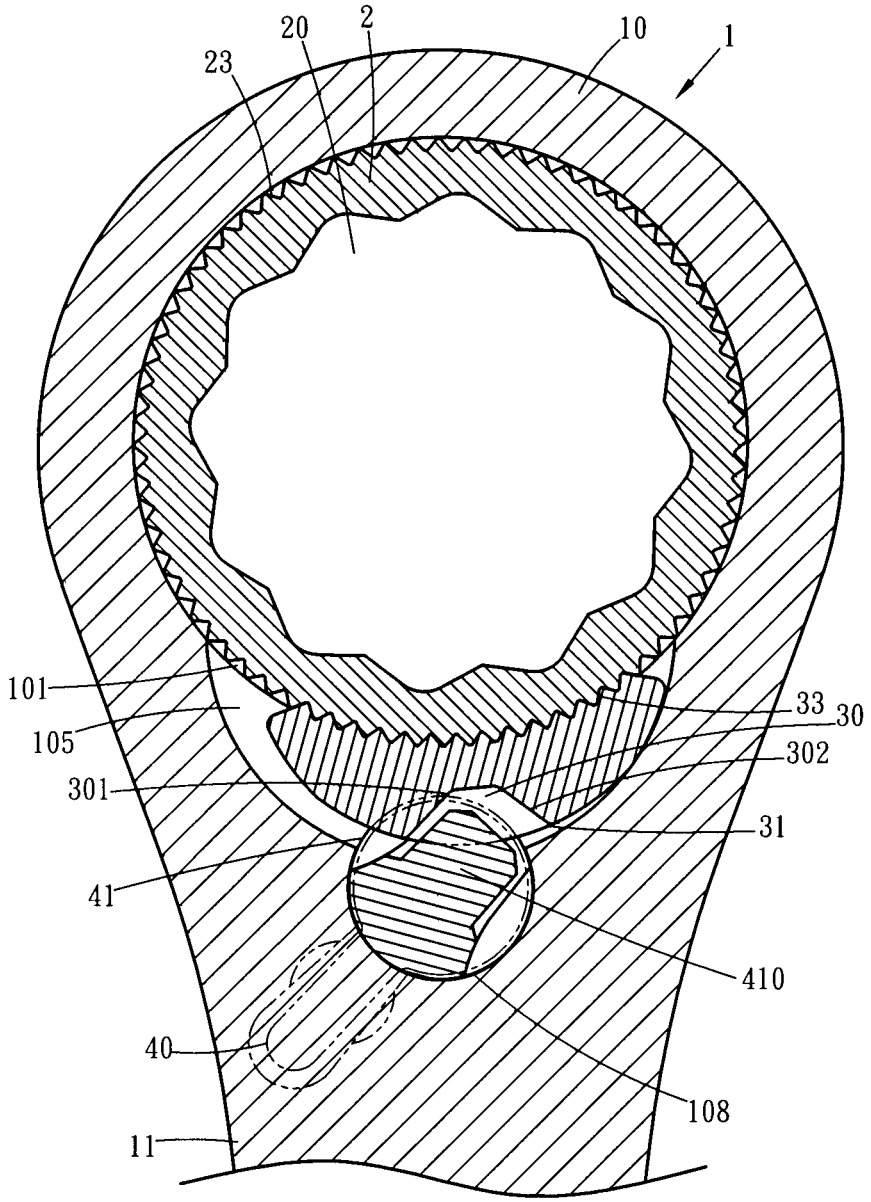
FIG. 5 is a cross sectional view to show that the lever is located at a position wherein the board is not in contact with the inclined faces of the recess.
Figure 6:
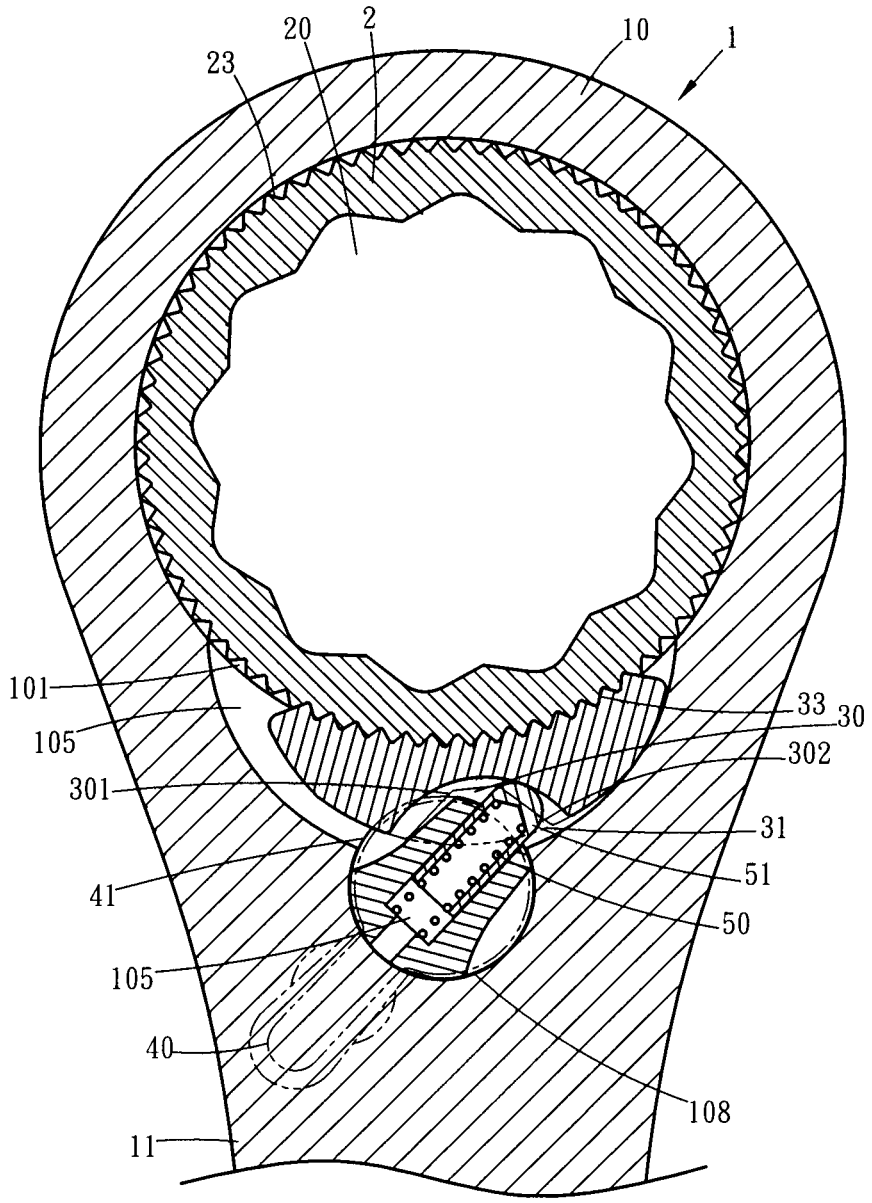
FIG. 6 is a cross sectional view to show the position of the push member in FIG. 5.

Further referring to FIGS. 5 and 6, a switching device 4 is engaged with the third room 108 and has a tubular portion 41 which is inserted in the third room 108. A lever 40 extends radially from the tubular portion 41 and exposed from the outside of the ratchet wrench. A slot 411 is defined radially in the outside of the tubular portion 41 and has an inner top and an inner bottom. A board 410 protrudes from the inner top of the slot 411. The lip 31 is inserted in the slot 411 and the board 410 is rested on the lip 31 and located in the recess 30. The recess 30 can be a semi-oval recess, or, the first inclined face 301 and the second inclined face 302 can be two curved faces. The board 410 is able to push either one of the two inclined faces 301, 302 to move the pawl 3 in the second room 105. A hole 415 is defined radially through the tubular portion 41 and located beneath the slot 411. A push unit 5 is located in the hole 415 of the tubular portion 41 and resiliently contacts between the inner periphery of the recessed portion 32 and the inner end of the hole 415. Specifically, the push unit 5 has a resilient member 50 and a push member 51 which is pushed by the resilient member 50. The push member 51 has a reception hole for receiving one end of the resilient member 50.

It is noted that the width between two sides of the board 410 is smaller than the width of the open end "A" so that the board 410 can be pivoted and moved to push the first inclined face 301 or the second inclined face 302 to move the pawl 3.

Figure 7:
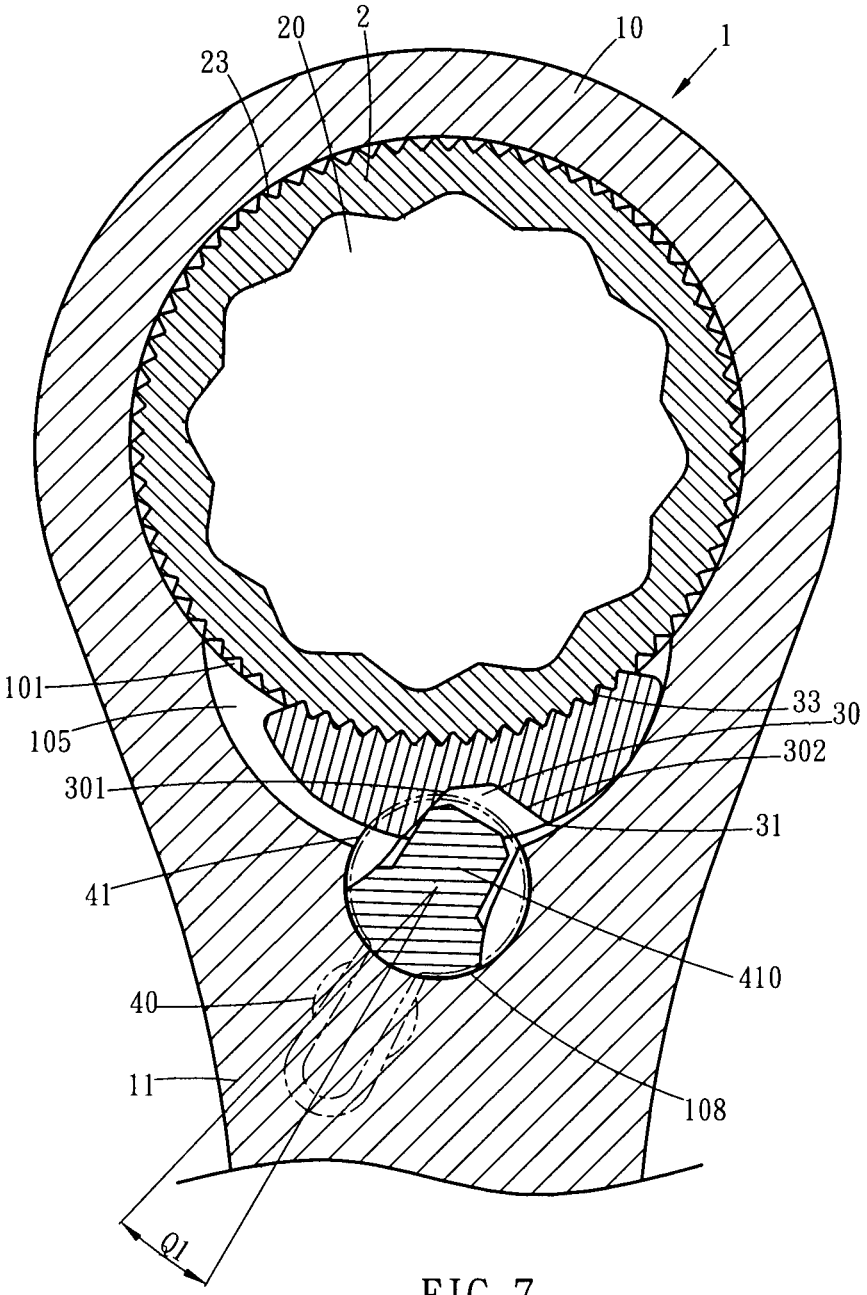
FIG. 7 is a cross sectional view to show that the lever is pivoted an angle wherein the board is in contact with one of the inclined faces of the recess.
Figure 8:
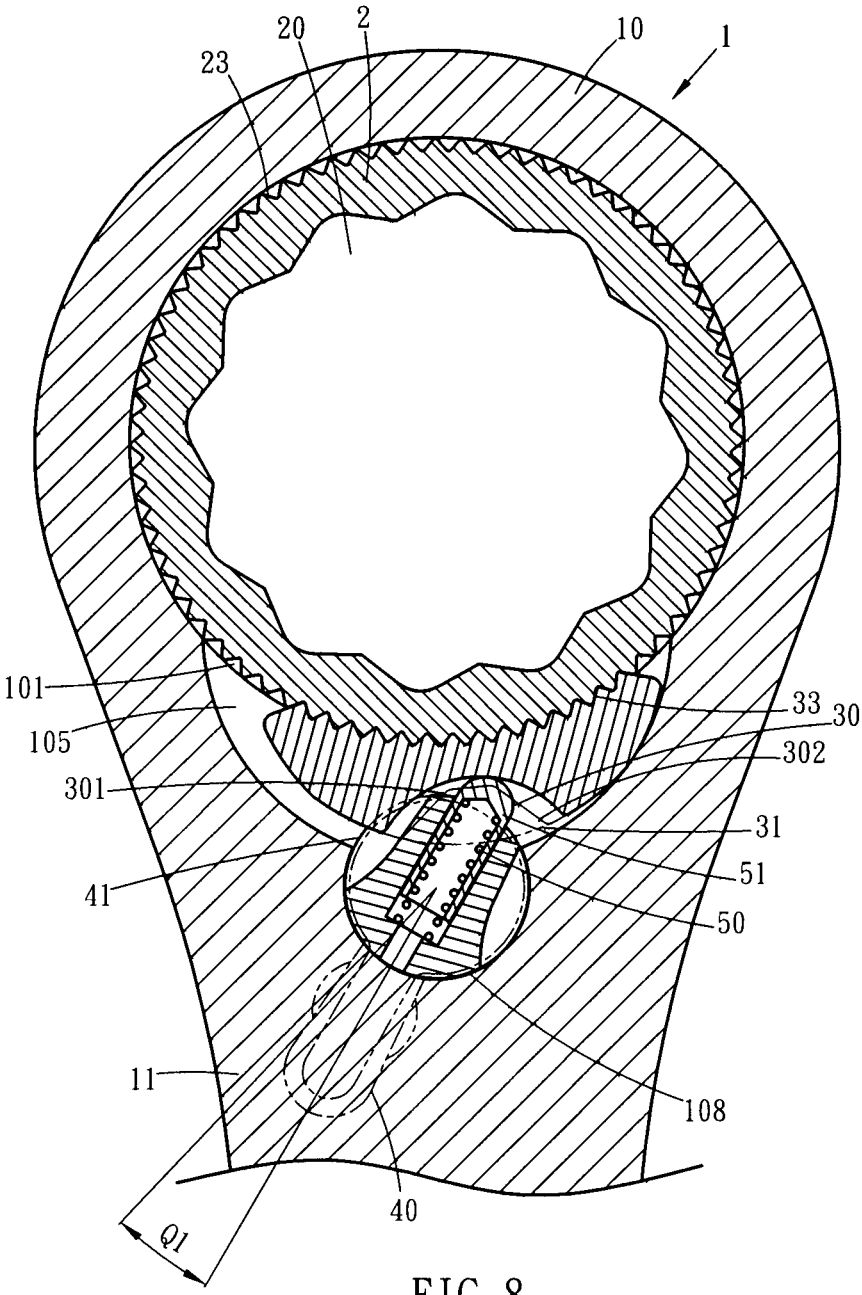
FIG. 8 is a cross sectional view to show the position of the push member in FIG. 7.

As shown in FIG. 5, the pawl 3 is located at the right most position in the second room 105, and the right side of the pawl 3 contacts against the right side of the second room 105. The pawl 3 is engaged with the driving member 2. The push member 51 is pushed by the resilient member 50 and contacts the inner periphery of the recessed portion 32 so as to keep the pawl 3 at the position as shown in FIG. 6. When the user pivots the lever 40 an angle "Q1" from the position in FIG. 5 to the position in FIG. 7 to rotate the tubular portion 41. The board 410 is moved in the recess 30 and contacts the inclined face 301 as shown in FIG. 7. In the same time, the push member 51 is moved along with the pivoting of the tubular portion 41 and guided by the inner periphery of the recessed portion 32 to compress the resilient member 50 so that the push member 51 is slightly moved into the hole 415 as shown in FIG. 8.

Figure 9:
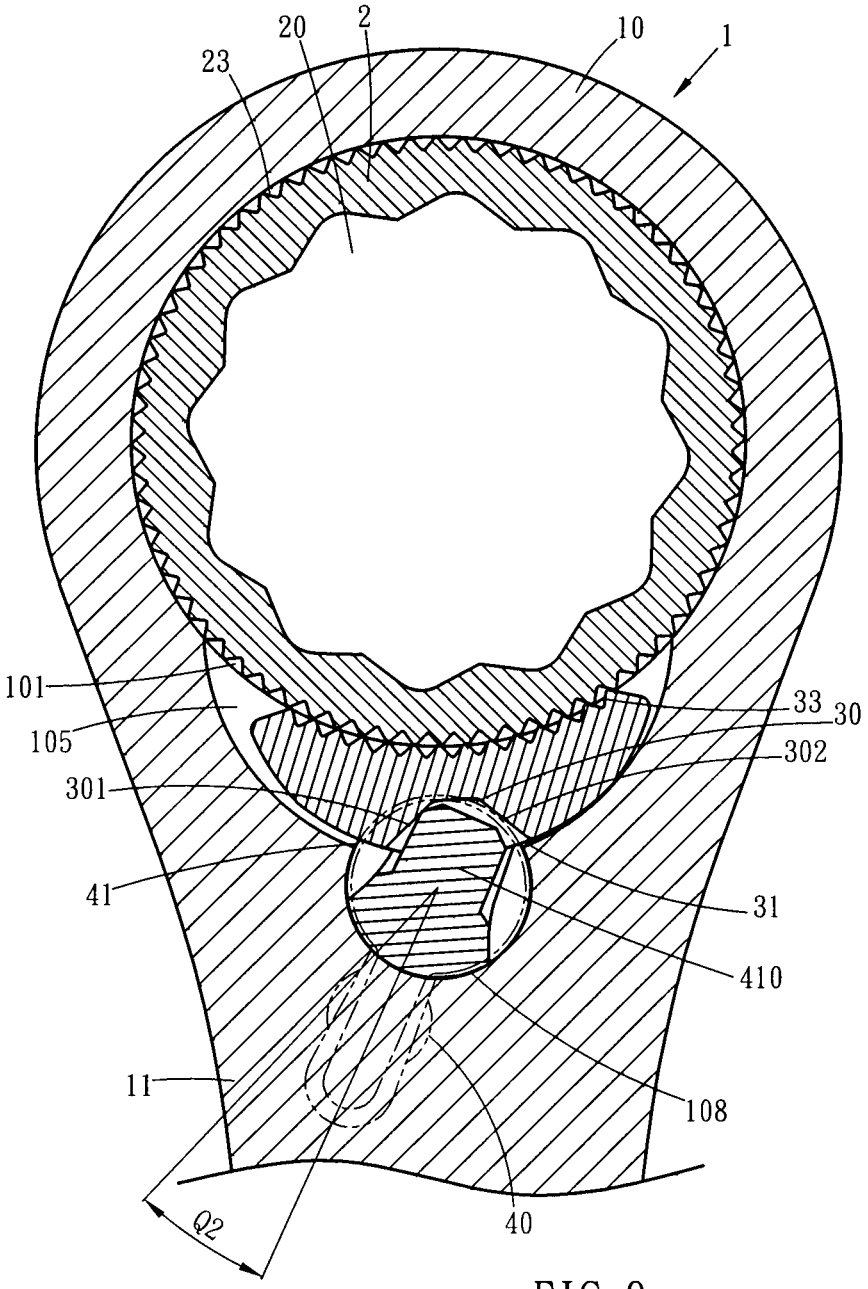
FIG. 9 is a cross sectional view to show that the lever is continuously pivoted to a position wherein the board pushes one of the inclined faces of the recess and the pawl is moved to disengage from the driving member.
Figure 10:
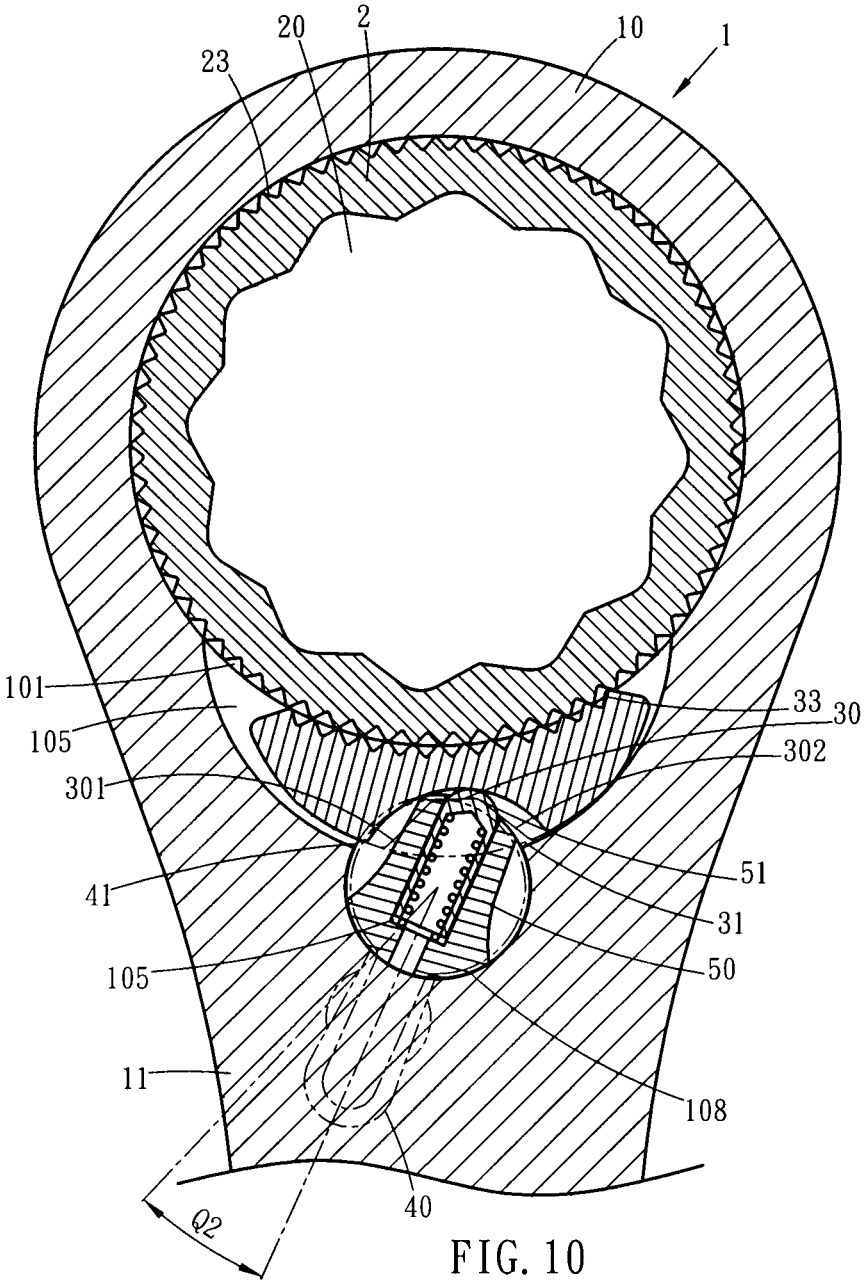
FIG. 10 is a cross sectional view to show the position of the push member in FIG. 9.

When the lever 40 is continuously pivoted an angle "Q2", the board 410 pushes the inclined face 301 of the recess 30 to move the pawl 3 toward left as shown in FIG. 9. The second teeth 33 are disengage from the first teeth 23 as shown in FIG. 10, in the meanwhile, the pawl 3 is moved toward left. The resilient member 50 is compressed and the push member 51 is moved into the hole 415 as shown in FIG. 10.

Figure 11:
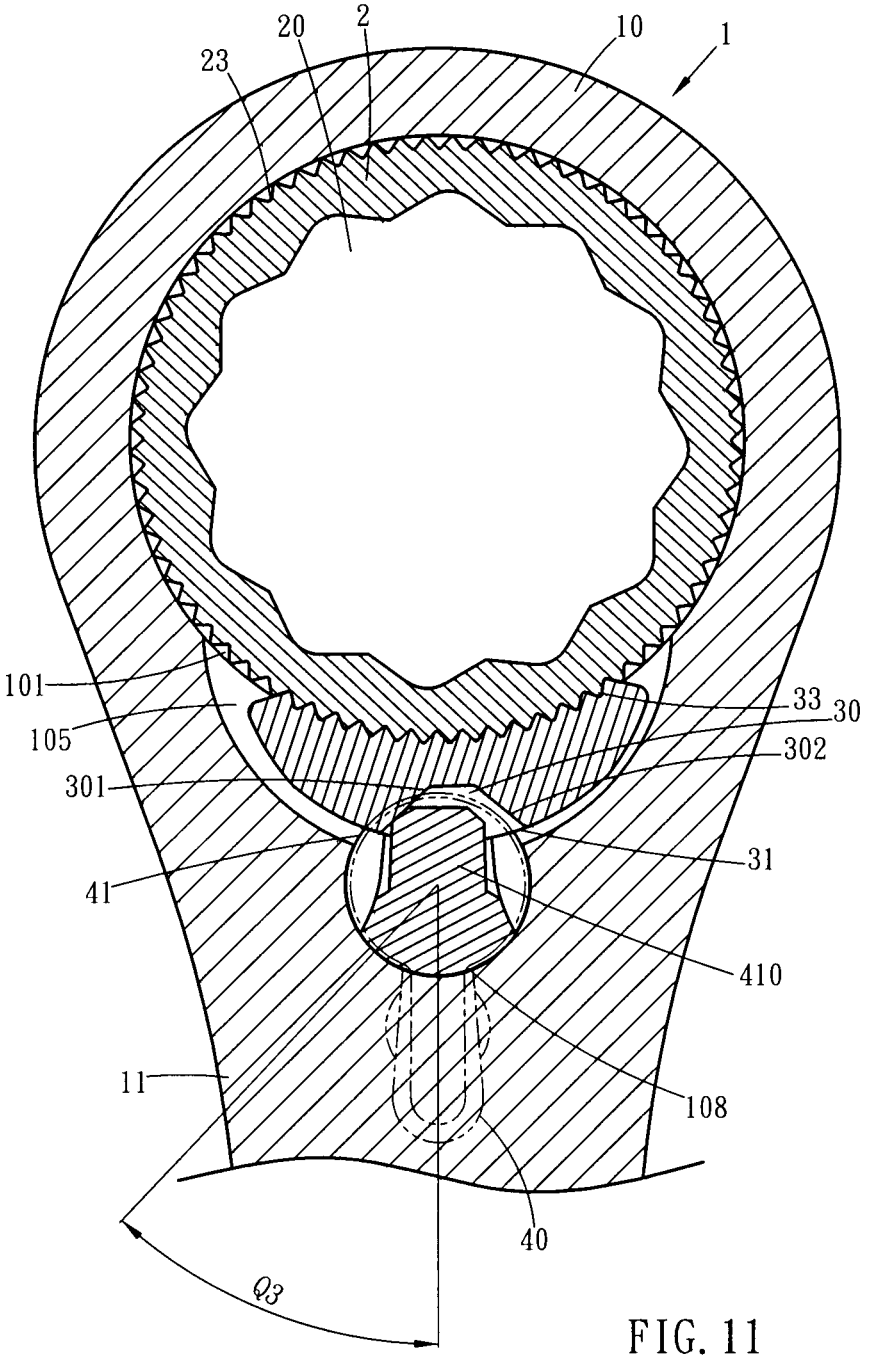
FIG. 11 is a cross sectional view to show that the lever is continuously pivoted to position the pawl which is engage with the driving member.
Figure 12:
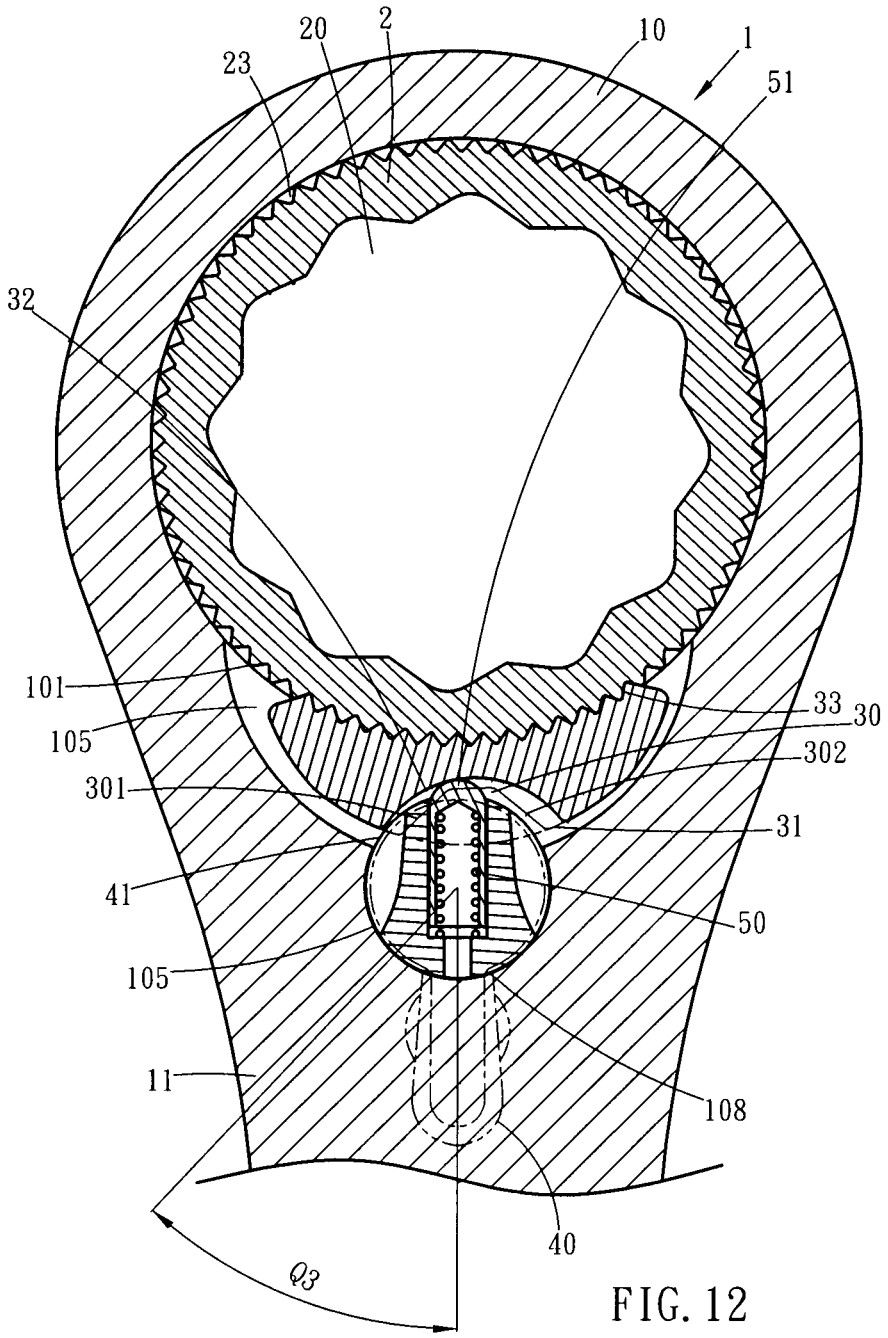
FIG. 12 is a cross sectional view to show the position of the push member in FIG. 11.

When the lever 40 is further pivoted to an angle "Q3" as shown in FIG. 11, the board 410 further pushes the inclined face 301 toward left until the lever 40 is moved to the central portion of the handle 11 as shown in FIG. 11. The second teeth 33 are engaged with the first teeth 23 again. The right side of the pawl 3 is removed from the right side of the second room 105. The push member 51 is further inserted into the hole 415 as shown in FIG. 12.

Figure 13:
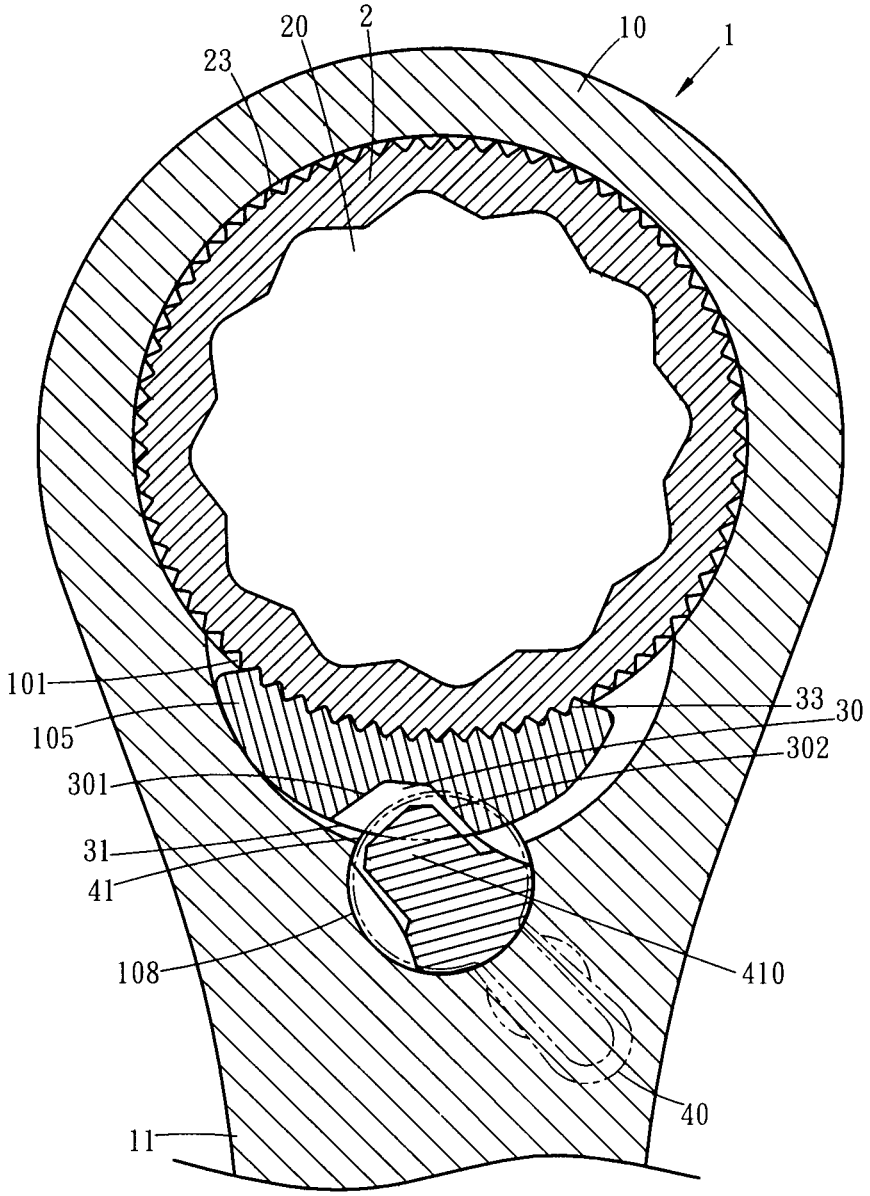
FIG. 13 is a cross sectional view to show that the lever is continuously pivoted so that the board is not in contact with the inclined faces of the recess.
Figure 14:
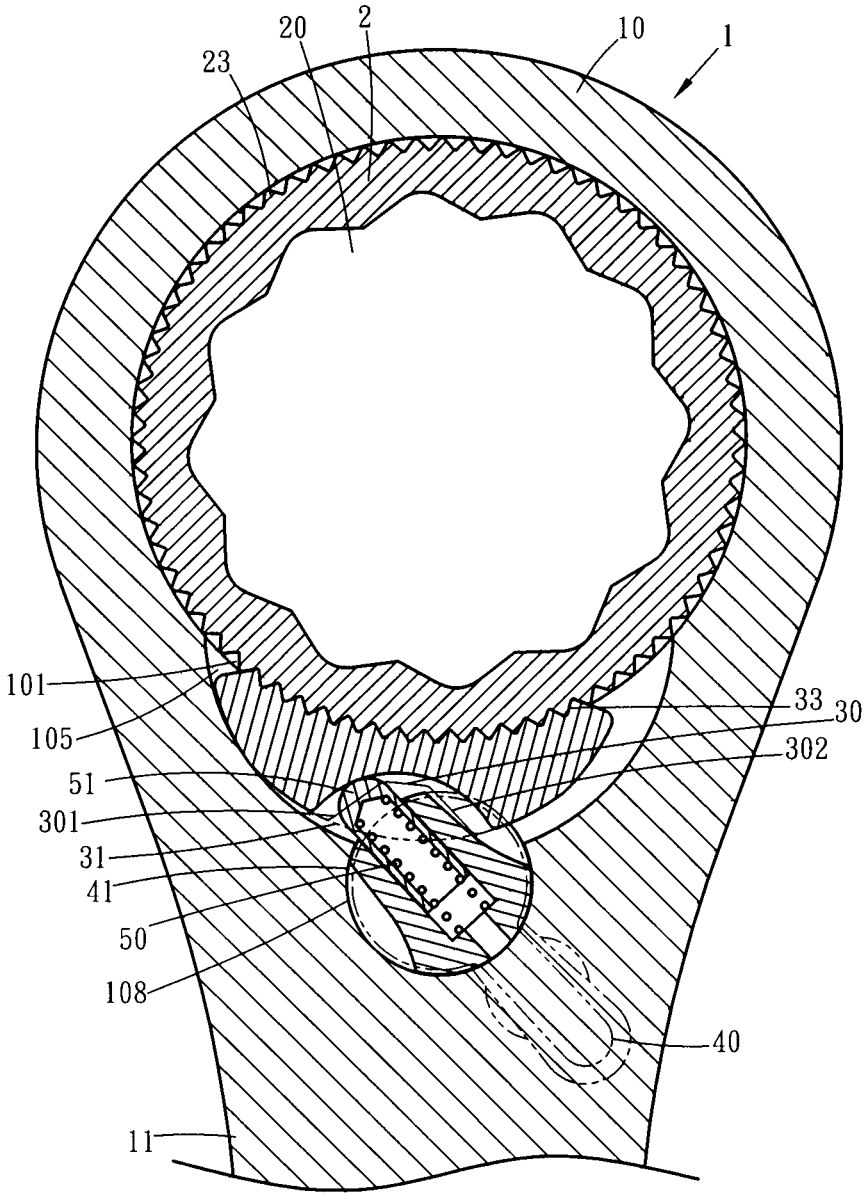
FIG. 14 is a cross sectional view to show the position of the push member in FIG. 13.

As shown In FIGS. 13 and 14, when the lever 40 is continuously pivoted to the right, the board 410 pushes the inclined face 301 and the pawl 3 is moved to the left most position in the second room 105, and the left side of the pawl 3 contacts against the left side of the second room 105. The push member 51 is pushed by the resilient member 50 and contacts at the left side of the recessed portion 32 as shown in FIG. 14 to position the pawl 3 which is firmly engaged with the driving member 2. By this way, the ratcheting direction of the ratchet wrench is changed successfully.

The lip 31 is inserted in the slot 411 of the tubular portion 41 of the switching device 4, and the board 410 is rested on the lip 31 so that the pivoting action of the switching device 4 is stable and effectively. The board 410 pushes either one of the inclined faces 301, 302 can effectively move the pawl 3 in the second room 105 so that the ratchet wrench is able to output higher torque.

While we have shown and described the embodiment in accordance with the present invention, it should be clear to those skilled in the art that further embodiments may be made without departing from the scope of the present invention.

What is claimed is:

1. A ratchet wrench comprising: a body having a head and a handle which is connected to the head, the head having a first room defined therethrough, a second room defined in an inner periphery of the first room, a third room defined in an inner periphery of the second room and having an opening which opens through a first side of the head, a support flange extending inward from the inner periphery of the first room and located at a lower portion of the head, a first groove defined in the inner periphery of the first room and located at a top portion of the head, the second room located between and communicating with the first and third rooms, the second room located beneath and covered by a portion of the head, and not opening to outside of the body;

a driving member located in the first room and having a polygonal driving portion defined therein, a second groove defined in an outer periphery of the driving member and located at a top portion of the driving member, an annular flange extending from an underside of the driving member, multiple first teeth formed in the outer periphery of the driving member and located between the second groove and the annular flange;

a clip engaged with the first and second grooves to retain the driving member in the first room;

a pawl located in the second room and having a recessed and curved front side, multiple second teeth defined in the front side of the pawl, a recessed portion defined in a rear side of the pawl and a lip extending from an inner periphery of the recessed portion, a recess formed between the lip and an upper portion of the recessed portion;

a switching device connected to the third room and having a tubular portion and a lever which extends radially from the tubular portion, a slot defined radially in an outside of the tubular portion and having an inner top and an inner bottom, a board protruding from the inner top of the slot, the lip inserted in the slot and the board rested on the lip and located in the recess, the board pushing an inside of the recess to move the pawl in the second room, a hole defined radially through the tubular portion and located beneath the slot, and a push unit located in the hole of the tubular portion and resiliently contacting between the inner periphery of the recessed portion and an inner end of the hole.

2. The ratchet wrench as claimed in claim 1, wherein the recess is defined by two inclined faces, the first and second inclined faces form an open end and a closed end, a width of the open end is wider than a width of the closed end, the board pushes the first inclined face or the second inclined face to move the pawl.

3. The ratchet wrench as claimed in claim 2, wherein the first inclined face and the second inclined face are two curved faces.

4. The ratchet wrench as claimed in claim 1, wherein the first groove of the first room and the opening of the third room are located on the same side of the body.

5. The ratchet wrench as claimed in claim 4, wherein the push unit has a resilient member.

6. The ratchet wrench as claimed in claim 1, wherein the first groove of the first room and the opening of the third room are located on two opposite sides of the body.

* * * * *